US006265370B1

(12) United States Patent
Newbegin

(10) Patent No.: US 6,265,370 B1
(45) Date of Patent: Jul. 24, 2001

(54) METHOD FOR SOAP MAKING

(76) Inventor: Hall Newbegin, P.O. Box 5535, Berkeley, CA (US) 94705

( * ) Notice: Subject to any disclaimer, the term of this patent is extended or adjusted under 35 U.S.C. 154(b) by 0 days.

(21) Appl. No.: 09/444,211

(22) Filed: Nov. 19, 1999

(51) Int. Cl.[7] ..... C11D 13/00

(52) U.S. Cl. ..... 510/458; 510/152; 510/459; 510/463; 510/481

(58) Field of Search ..... 510/130, 152, 510/458, 459, 463, 481

(56) References Cited

U.S. PATENT DOCUMENTS

| | | | | |
|---|---|---|---|---|
| 2,825,190 | | 3/1958 | Heald . | |
| 4,453,909 | | 6/1984 | Lindauer et al. . | |
| 4,459,285 | | 7/1984 | Grollier et al. . | |
| 4,496,596 | | 1/1985 | Stoeckli et al. . | |
| 4,569,839 | | 2/1986 | Grollier et al. . | |
| 4,604,282 | | 8/1986 | Grollier et al. . | |
| 5,152,989 | | 10/1992 | Kemp . | |
| 5,156,794 | | 10/1992 | Nakanishi et al. . | |
| 5,246,693 | | 9/1993 | Grollier et al. . | |
| 5,534,212 | | 7/1996 | Chokappa et al. . | |
| 5,695,748 | | 12/1997 | Francis . | |
| 5,723,420 | * | 3/1998 | Wei et al. | 510/101 |
| 5,738,851 | | 4/1998 | Colavito . | |
| 5,858,338 | | 1/1999 | Piot et al. . | |
| 5,898,027 | * | 4/1999 | Bardenberg et al. | 510/483 |
| 5,965,501 | * | 10/1999 | Rattinger et al. | 510/146 |
| 5,972,859 | * | 10/1999 | Farrell et al. | 510/141 |

* cited by examiner

*Primary Examiner*—Necholus Ogden
(74) *Attorney, Agent, or Firm*—Dellet and Walters

(57) ABSTRACT

A method of soap making comprises pulverizing naturally scented flora or other material with components of the soap making process prior to saponification. An improved scented soap is thereby provided with an intensified natural scent.

34 Claims, 2 Drawing Sheets

METHOD FOR SOAP MAKING

BACKGROUND OF THE INVENTION

This invention relates to soap making and more specifically to a method for making scented soaps that uses the raw plant material in the process and renders a soap with a natural scent that smells more like real flora than soaps scented with traditional scenting techniques.

Soap is made by the combination of a fatty acid such as those found in vegetable or animal oils, and a basic solution such as sodium hydroxide or lye. These elements are mixed together under the application of heat until they are neutralized in a process called saponification. Colorants are added for color and essential or fragrance oils are added for scent.

Fragrance oils are chemically made scents that are added to the soap near the end of the soap making process. Essential oils are aromatic oils which are extracted from flora and are also added near the end of the soap making process. If a plant material possessing a desired scent, medicinal quality, or color is soaked or "infused" in the fatty acids used to make soap, these fatty acids will absorb some of these qualities and thus impart these qualities to the finished soap.

Problems, however, exist with these prior art methods of scenting the soap. Most of the fragrance oils do not smell like plants occurring in nature and are usually discernible over a natural oil. Also because of their chemical nature, fragrance oils are not as desirable to many consumers. A problem with essential oil scented soaps is that essential oils are extremely expensive and available in a limited number of scents. The types of essential oils which are available tend to be made from European species of plants so that local varieties of plants in other regions of the world are not represented. Additionally, essential oils often do not smell much like the actual plant that they are made from. Essential oils tend to emphasize "floral" perfume-like smells, and not the natural smell of the actual plant. While fatty acids infused with real plants can smell closer to the aroma of a natural plant and can be made from any flora, local or not, the scent is so weak as to be inconsequential and only valuable as a secondary source of scent.

Because of the above mentioned problems in the prior art, making a strongly scented soap bearing the natural aroma of flora has heretofore been unrealizable.

SUMMARY OF THE INVENTION

In accordance with the invention, an improved soap making process renders a soap bearing a strong natural scent. The soap according to the process can be made to carry the scent of any region's flora.

Accordingly, it is an object of the present invention to provide an improved method for making scented soap.

It is a further object of the present invention to provide an improved method for making soap that carries a strong scent of selected natural vegetation.

It is another object of the present invention to provide an improved method of making scented soap that does not require the addition of fragrance oils or essential oils extracted elsewhere.

The subject matter of the present invention is particularly pointed out and distinctly claimed in the concluding portion of this specification. However, both the organization and method of operation, together with further advantages and objects thereof, may best be understood by reference to the following description taken in connection with the accompanying drawings wherein like reference characters refer to like elements.

DETAILED DESCRIPTION

The improved system of soap making according to a preferred embodiment of the present invention, comprises a series of steps rendering soap that bears the natural smell and color of specifically selected flora.

Figure 1:
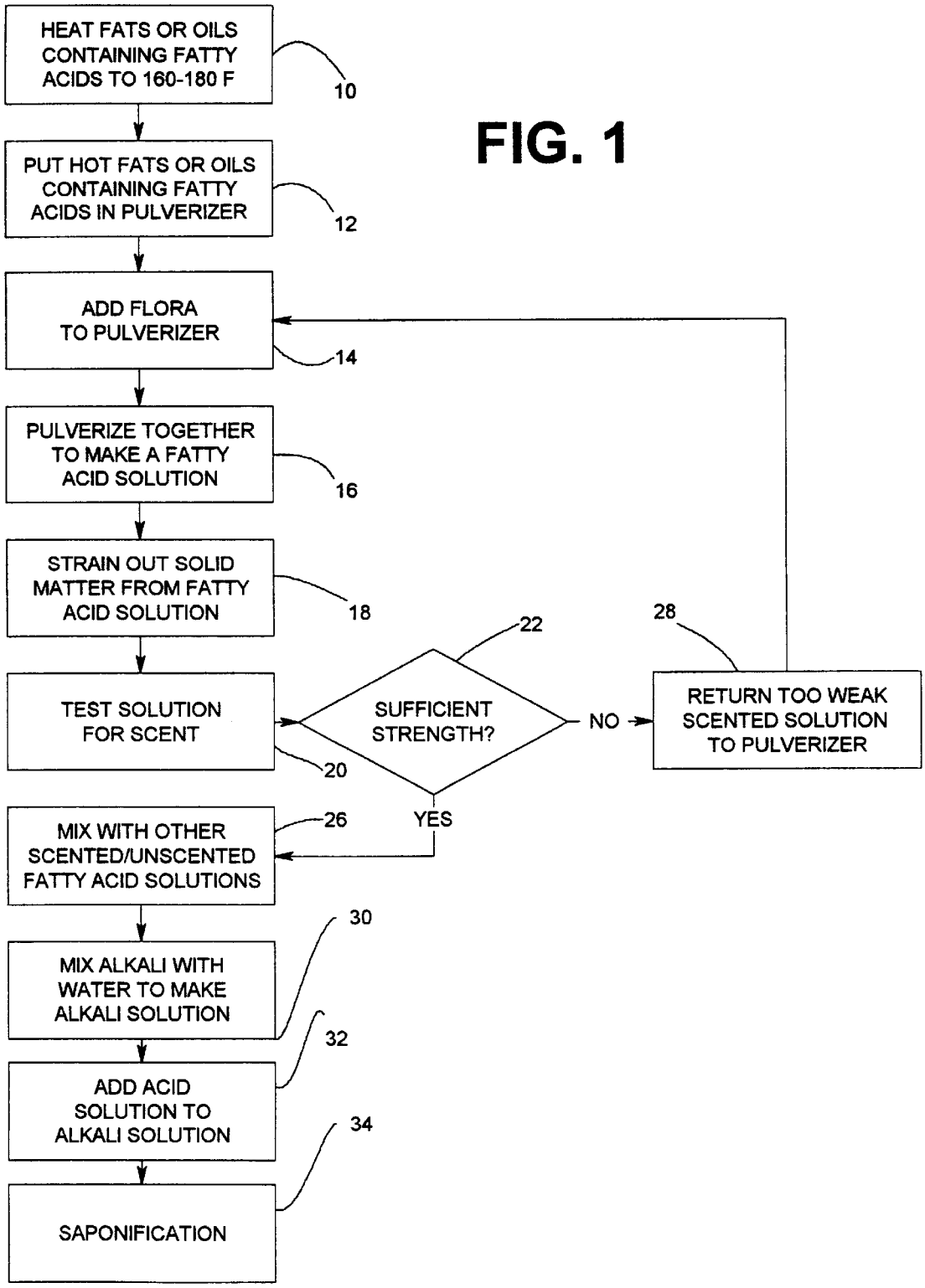
FIG. 1 is a block diagram showing the steps involved in the preferred embodiment soap making method.

Referring to FIG. 1, a block diagram of the preferred embodiment of the improved soap making method, it can be seen that this process may involve as few as ten steps. The first step (block 10) involves heating the fatty acids until they are in liquid form. Fatty acids are found naturally in the liquid form as oils or in the solid form as fats. Heating these fatty acids ensures that the fatty acids are in a liquid form with a viscosity low enough to accommodate subsequent steps of the process and that the fatty acids have sufficient temperature for the process. In the preferred embodiment, fatty acids from vegetable or olive oil are used and are heated to between 160 and 180 degrees F.

In the second step 12, the hot, liquid fatty acid is placed into a pulverizing unit. The pulverizing unit is suitably a blender. Next, in step 14 flora is added into the pulverizing unit. The flora can be either dried flora or fresh flora. Prior to adding the flora, it may be "sized", or otherwise cut into pieces if necessary, for easier handling or pulverizing. The flora is usually chosen for its aromatic or distinctive fragrance. Two examples of such fragrant flora are cedar and sage. The part of the flora selected for pulverization is generally the most fragrant and youngest growth such as the tips, flowers, petals, needles, fruit or leaves. However in several of the tree species branch tips are used. The particular flora chosen will determine what part of the plant gets pulverized. If the part to be pulverized is extremely hard, as is the case with trees and bushes (for example, cedar), or particularly fibrous (for example, some types of sage), the part may require reduction to smaller pieces prior to insertion into the pulverizer.

Once the fatty acids and flora have been added to the pulverizer, then step 16 involves the mechanical pulverization of the flora in the fatty acid. The period of pulverization is brief and typically lasts thirty seconds or until the flora is thoroughly pulverized in the hot liquid fatty acid. The result of the pulverizing step is a fatty acid solution. There is no pre-pulverization soaking period or post-pulverization soaking period necessary, as the scent imparted to the fatty acid in the pulverization process is not noticeably enhanced by either of these techniques.

Next, in step 18, straining of the solids from the fatty acid solution is done by pouring the fatty acid solution through a cloth such as a fine cheesecloth or a woven cotton fabric. The remaining particulate size left in the solution varies with the type of effect sought but typically the particulate remaining in the fatty acid solution is not large enough to be abrasive to the touch.

Now, referring to block 20, the fatty acid solution is tested for strength of scent as a part of a decision making process. If the scent is acceptable (decision block 22), then the process continues with block 26, as discussed hereinbelow. If, however, in decision block 22, the scent is not sufficient and is too weak, then the fatty acid solution is returned to the pulverizing unit at step 14 (block 28) where additional flora is added to the solution and the process continues. Once a fatty acid solution having a scent of sufficient strength is obtained, and the answer at decision block 22 is "yes", step 26 can be performed.

In step 26, the scented fatty acid solution is combined with other fatty acids (for example, palm or coconut oil) to make a combined fatty acid solution which is ready to be made into soap. Although a single fatty acid can be used to make soap, as anyone who is skilled in the art of soap making understands, a mixture of different fatty acids is preferred to make a high quality bar of soap. Typically, different fatty acids are chosen for the different qualities they add to the soap (for example coconut oil for its lather, or palm oil for its hardness). Achieving the proper balance of both (1) types of fatty acids, and (2) their relative proportion to one another, is in essence the art of soap making and is well understood by those skilled in the art. In the process according to the present invention, the scented fatty acid solution is combined with other fatty acids which may or may not be scented by the process described in steps 10 to 18 above. Typically, if the flora or combination of flora being used has a particularly strong scent, a smaller portion of the combined fatty acid solution is scented by the inventive process. If the flora being used has a relatively weak scent, a larger portion or possibly all of the combined fatty acid solution will be scented. It will be understood that in accordance with the invention, any combination of fatty acids can be used, and that any individual flora or combination of flora can be used to scent one or more of those different fatty acids. This ability to use singular or plural flora or fatty acids allows for a great variety of potential flora combinations and scents.

In step 30 an alkali is mixed with water to make an alkali solution. When the alkali begins to dissolve in the water, the resulting chemical reaction heats the solution to over 200 degrees. Typically, the alkali used is lye. Next, in step 32, the combined scented fatty acid solution is heated to greater than 100 degrees Fahrenheit, in order to melt any solid fatty acids, and is then allowed to cool to approximately 100 degrees Fahrenheit. When the alkali solution has cooled to approximately 100 degrees Fahrenheit, it is added to the combined fatty acid solution and mixed to homogeneity which begins the saponification, the actual chemical reaction for forming soap. After the mixture has saponified to a sufficient degree, the soap is poured into a mold to cool.

Figure 2:
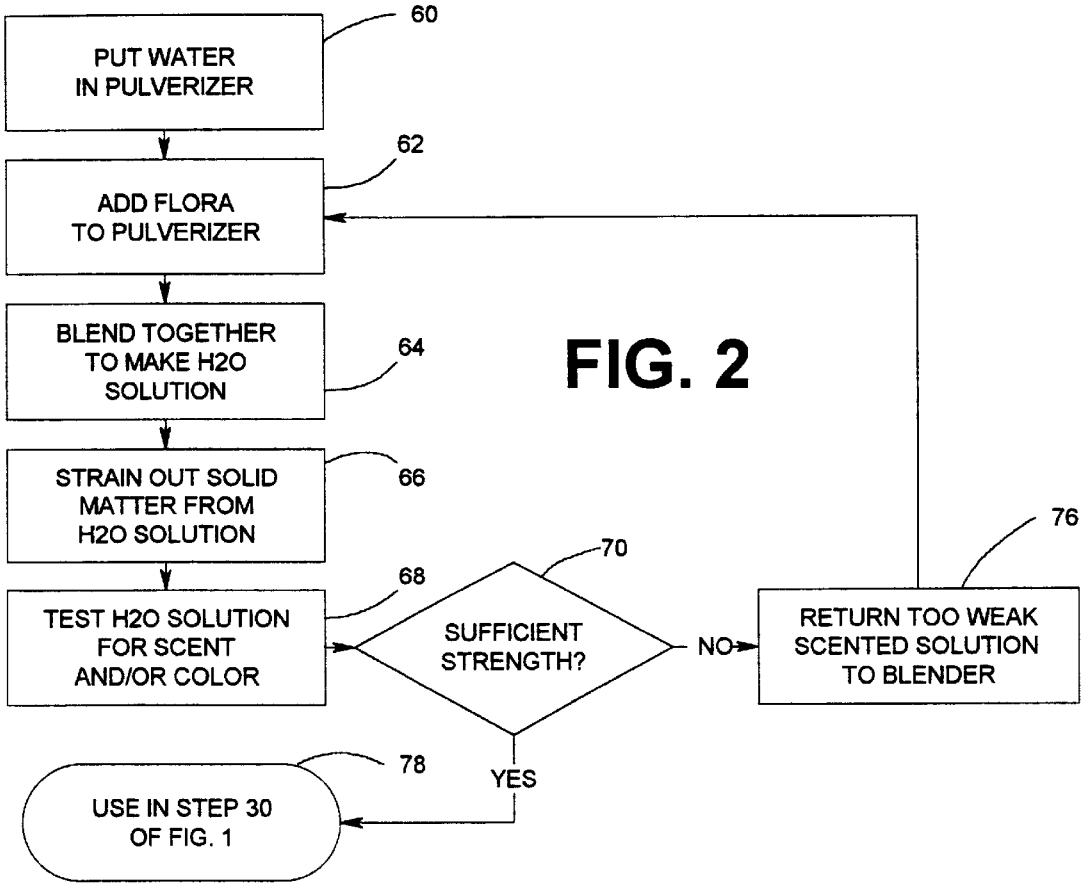
FIG. 2 is a block diagram showing an alternate embodiment of soap making method steps that may be employed with the process of FIG. 1.

FIG. 2, a block diagram showing the steps involved in an alternate embodiment soap making method to add scent to the alkali component, illustrates another method for enhancing the scent and color of soap beyond that of the preferred embodiment method. In this alternate method, flora is pulverized in the water to be used to liquefy and dilute the alkali as employed in step 30 (FIG. 1) of the basic process. The flora may be the same species or type of flora used in making the scented fatty acid solution in FIG. 1, a different species, or a combination of species, depending upon the desired effect. The resulting finished soap has an intensified or modified scent and color over the soap produced by the preferred embodiment method. This second alternate embodiment method is particularly useful when dealing with soft or subtle scents.

In accordance with the process of FIG. 2, steps corresponding to the scenting steps of FIG. 1 are performed. However, the scented water thereby produced is saved (block 78) and is combined with the alkali in step 30 (FIG. 1), either full strength or diluted.

Although in the preferred embodiment, lye is employed as the alkali component, other suitable alkali's may be used alone or in combination with others. Some alternate acceptable alkalis are potash, pearlash, caustic soda, causticized wood ashes, sodium hydroxide, and potassium hydroxide. The alkali used neither strengthens nor diminishes the strength of the scent or color.

The soap making processes according to the present invention are compatible with most other generally known steps for enhanced soap making such as the addition of extra oil in the final stages of saponification to "superfat" the soap to give enhanced skin moisturizing properties.

While the illustrated embodiments employ vegetable oil as the fatty acids, other suitable fatty acids may be used in the processes. Some alternate acceptable fatty acids are sweet almond, apricot kernel, arachis, avocado, babassu, borage, brazil nut, beef hoof, white beeswax, brazil nut, cow butterfat, goat butterfat, calendula, canola, castor, chicken fat, chinese bean, cocoa butter, coconut, cod-liver, coffee-seed, colza, corn, cottonseed, earthnut, evening primrose, flaxseed, florence, olive, gigely tree, goose fat, grapeseed, hazelnut, hemp seed, java cotton, jojoba, kapok, karite butter (shea), katchung, kukui nut, lanolin, lard, linseed, loccu, macadamia, maize, mango, mink, mustard, neat's foot, neem, niger-seed, nutmeg butter, olium olivate, olive, palm butter, palm kernel, palm, stearic palm, peanut, perilla, poppyseed, pumpkinseed, ramic, rape, rapeseed, rice bran, ricinus, rose hip, rose mosqueta, safflower, sesame seed, shea butter, vegetable shortening, soybean, sunflower seed, sweet oil, tallow (bear, beef, chinese vegetable, deer, goat and sheep), teal/teel/til, theobroma, tung, walnut and wheat-germ.

Suitable flora comprise sage (Salvia spp.), hummingbird sage, bay, California bay, cedar, red cedar (*Thuja plicata*), fir (Abies spp.), douglas fir (Pseudotsuga spp.), juniper (Juniperus spp.), desert lavender (Hyptis spp.), pitcher sage (Lepechinia spp.), lemon balm (Melissa spp.), mint (Mentha spp.), coyote mint (Monardella spp.), bluecurls (Trichostema spp.), laurel (Umbellularia spp.), incense cedar (Calocedrus spp.), cypress (Cupressus spp.), spruce (Picea spp.), pine (Pinus spp.), hemlock (Tsuga spp.), yew (Taxus spp.), redwood (Sequoia spp.), bayberry (Myrica spp.), giant sequoia (Sequoadendron giganteum), angelica (Angelica spp.), cow parsnip (Heracleum spp.), lavender (Lavendula spp.), rose (Rosa spp.), rosemary (Rosemarinarus spp.), geranium (Geranium spp.) and eucalyptus to name a few. Any material having a pleasing smell may be employed.

In the preferred embodiment, the pulverizing unit comprises a blender. An exemplary blender comprises a Waring brand commercial blender, for example, model BB160. However, those skilled in the art will understand that other blenders, whether consumer or commercial models, are suitable. Various other equipment such as commercial food processors, grinders, mashers, etc. may also be employed. The straining steps 18 and 66 are suitably done with cheese cloth or other cloth having a desired weave to allow straining. However other straining devices such as an appropriately sized paper or mesh steel filter are also suitable for the method. To speed the straining process the fatty acid or water solution may be hydraulically pressurized on the upstream side of the straining device.

An exemplary mix of fatty acids is 44% palm oil, 28% coconut oil and 28% olive oil, although the types and percentages of oils will vary depending on the desired results.

Also, the preferred feature of the soap produced by the present invention is the scent. However, the coloration of the soap is also suitably enhanced or affected by the method.

Accordingly, the steps of the invention for determining whether the scent is sufficient are modifiable to make a corresponding decision as to coloration of the solution.

While plural embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A method of bar soap making comprising the steps of:

pulverizing a flora in a fatty acid so as to form a scented fatty acid solution, wherein said flora comprises plant material of at least one species of plant;

separating at least most of the pulverized flora from the scented fatty acid solution; and performing saponification on said scented fatty acid solution, wherein resulting saponification renders a soap.

2. The method of bar soap making according to claim 1 further comprising the step of heating said tatty acid to a liquid state before said step of pulverizing.

3. The method of bar soap making according to claim 2 wherein said heating comprises heating said fatty acid to a temperature in the range of 160–180 degrees F.

4. The method of bar soap making according to claim 1 wherein said pulverizing step comprises pulverizing in a blender.

5. The method of bar soap making according to claim 1 wherein the step of separating at least most of the pulverized flora from said scented fatty acid solution to remove particulate flora matter comprises straining substantially all of the pulverized flora from said scented fatty acid solution.

6. The method of bar soap making according to claim 1 wherein the scented fatty acid is mixed with at least one other fatty acid prior to saponification.

7. The method of bar soap making according to claim 6 wherein at least one said other fatty acid is scented.

8. The method of bar soap making according to claim 1 wherein said flora comprises a fresh flora.

9. The method of bar soap making according to claim 1 wherein said flora comprises a dried flora.

10. The method of bar soap making according to claim 1 wherein said flora comprises a single species of plant.

11. The method of bar soap making according to claim 1 wherein said flora comprises plural species of plant.

12. The method of bar soap making according to claim 1 wherein the fatty acid is selected from the group consisting of sweet almond, apricot kernel, arachis, avocado, babassu, borage, brazil nut, beef hoof, white beeswax, brazil nut, cow butterfat, goat butterfat, calendula, canola, castor, chicken fat, chinese bean, cocoa butter, coconut, cod-liver, coffee-seed, colza, corn, cottonseed, earthnut, evening primrose, flaxseed, florence, olive, gigely tree, goose fat, grapeseed, hazelnut, hemp seed, java cotton, jojoba, kapok, karite butter (shea), katchung, kukui nut, lanolin, lard, linseed, loccu, macadamia, maize, mango, mink, mustard, neat's foot, neem, niger-seed, nutmeg butter, olium olivate, olive, palm butter, palm kernel, palm, stearic palm, peanut, perilla, poppyseed, pumpkinseed, ramic, rape, rapeseed, rice bran, ricinus, rose hip, rose mosqueta, safflower, sesame seed, shea butter, vegetable shortening, soybean, sunflower seed, sweet oil, tallow (bear, beef, chinese vegetable, deer, goat and sheep), teal/teel/til, theobroma, tung, walnut and wheat-germ.

13. A method of bar soap making comprising the steps of:

pulverizing a flora with a heated fatty acid to form a scented fatty acid solution, wherein said flora comprises plant material of at least one species of plant;

separating at least most of the pulverized flora from said scented fatty acid solution; and performing saponification of said scented fatty acid.

14. The method of bar soap making according to claim 13 wherein said separating step comprises straining said scented fatty acid solution of flora particulate.

15. The method of bar soap making according to claim 13 wherein said pulverizing is performed with a blender.

16. A method of bar soap making, wherein said soap making employs plural constituents, comprising the steps of:

pulverizing plant material from at least one plant species in at least one of said plural constituents to form a scented solution;

separating substantially all to all of the pulverized plant material from the scented solution; and performing saponification on the scented solution.

17. The method of bar soap making according to claim 16 wherein said pulverizing step comprises pulverizing in a blender.

18. The method of bar soap making according to claim 16 wherein said scented solution is combined with other of the plural constituents prior to said step of performing saponification.

19. A method for making a constituent for use in a bar soap making process comprising the steps of:

providing a component used in soap making;

providing a flora, said flora comprising plant material of at least one species of plant;

pulverizing said flora and said component together; and separating at least most of the pulverized flora from said component, thereby resulting in a constituent for soap making.

20. The method of bar soap making according to claim 1 wherein said separating step comprises straining the pulverized flora from the scented fatty acid solution.

21. The method of bar soap making according to claim 16 wherein said step of separating substantially all of the pulverized plant material from the scented solution comprises straining the pulverized plant material from the scented fatty acid solution.

22. The method of bar soap making according to claim 19 wherein said step of separating at least most of the pulverized flora from said component comprises straining the pulverized flora from the component.

23. The method of bar soap making according to claim 13 wherein said flora comprises a dried flora.

24. The method of bar soap making according to claim 13 wherein said flora comprises a fresh flora.

25. The method of bar soap making according to claim 16 wherein said flora comprises a dried flora.

26. The method of bar soap making according to claim 16 wherein said flora comprises a fresh flora.

27. The method for making a constituent for use in a bar soap making process according to claim 19 wherein said flora comprises a fresh flora.

28. The method for making a constituent for use in a bar soap making process according to claim 19 wherein said flora comprises a dried flora.

29. A method of providing a scent to a generally liquid constituent of a bar soap, comprising the steps of:

pulverizing plant material of at least one species of plant in the constituent to form a scented liquid; and processing the scented liquid to remove portions of the pulverized plant material from the liquid.

30. The method of providing a scent to a generally liquid constituent of a bar soap according to claim 29 wherein said plant material comprises a fresh plant material.

31. The method of providing a scent to a generally liquid constituent of a bar soap according to claim 29 wherein said plant material comprises a dried plant material.

32. The method of providing a scent to a generally liquid constituent of a bar soap according to claim 29 wherein said liquid constituent comprises an oil or a fatty acid.

33. The method of providing a scent to a generally liquid constituent of a bar soap according to claim 29, wherein said step of processing the scented liquid to remove portions of the pulverized plant material from the liquid comprises straining the pulverized plant material from the liquid.

34. The method of providing a scent to a generally liquid constituent of a bar soap according to claim 29, wherein said at least one species of plant is selected from the group consisting of sage (Salvia spp.), hummingbird sage, bay, California bay, cedar, red cedar (*Thuja plicata*), fir (Abies spp.), douglas fir (pseudotsuga spp.), juniper (Juniperus spp.), desert lavender (Hyptis spp.), pitcher sage (Lepechinia spp.), lemon balm (Melissa spp.), mint (Mentha spp.), coyote mint (Monardella spp.), bluecurls (Trichostema spp.), laurel (Umbellularia spp.), incense cedar (Calocedrus spp.), cypress (Cupressus spp.), spruce (Picea spp.), pine (Pinus spp.), hemlock (Tsuga spp.), yew (Taxus spp.), redwood (Sequoia spp.), bayberry (Myrica spp.), giant sequoia (*Sequoadendron giganteum*), angelica (Angelica spp.), cow parsnip (Heracleum spp.), lavender (Lavendula spp.), rose (Rosa spp.), rosemary (Rosemarinarus spp.), geranium (Geranium spp.) and eucalyptus.

* * * * *